US005517982A

United States Patent [19]

Grivas

[11] Patent Number: 5,517,982

[45] Date of Patent: May 21, 1996

[54] PORTABLE DEVICE FOR PROVIDING AIR TO THOSE TRAPPED WITHIN A BURNING BUILDING

[76] Inventor: Dimitrios E. Grivas, 540 W. Roscoe #275, Chicago, Ill. 60657

[21] Appl. No.: 203,927

[22] Filed: Mar. 1, 1994

[51] Int. Cl.[6] ..... A62B 5/00

[52] U.S. Cl. ..... 128/200.24; 128/206.25; 128/202.27

[58] Field of Search ..... 128/205.24, 205.25, 128/205.26, 203.13, 206.25, 206.27, 206.28, 207.12, 207.13, 202.27; 454/254, 264, 370

[56] References Cited

U.S. PATENT DOCUMENTS

| | | | |
|---|---|---|---|
| 879,391 | 2/1908 | Leonard | 128/203.12 |
| 1,239,634 | 9/1917 | Stuart | 128/203.12 |
| 4,054,084 | 10/1977 | Palmer . | |
| 4,380,187 | 4/1983 | Wicks . | |
| 4,467,796 | 8/1984 | Beagley | 128/205.25 |
| 4,640,278 | 2/1987 | Barry | 128/206.27 |
| 4,703,808 | 11/1987 | O'Donnell . | |
| 4,905,684 | 3/1990 | Heffer | 128/206.28 |
| 4,928,583 | 5/1990 | Taylor et al. . | |
| 4,944,216 | 7/1990 | McCutcher . | |
| 4,945,891 | 8/1990 | Cecil | 454/64 |
| 5,069,115 | 12/1991 | Fleischer | 454/64 |
| 5,178,581 | 1/1993 | Del Monte . | |

FOREIGN PATENT DOCUMENTS

| | | | |
|---|---|---|---|
| 970939 | 11/1958 | Germany | 128/205.26 |
| 448060 | 6/1936 | United Kingdom | 128/205.26 |

*Primary Examiner*—Christopher A. Bennett
*Assistant Examiner*—William J. Deane, Jr.
*Attorney, Agent, or Firm*—Patula & Associates

[57] ABSTRACT

A portable device for providing air to those trapped within a smoke-filled building includes a base member for mounting a building opening such as a window, an air conduit such as an air hose mounted on the base and capable of being lowered to an area having breathable air, and an extendable boom for positioning the air conduit away from the building. A user simply connects a breathing instrument to the air conduit after lowering, to receive breathable air.

23 Claims, 4 Drawing Sheets

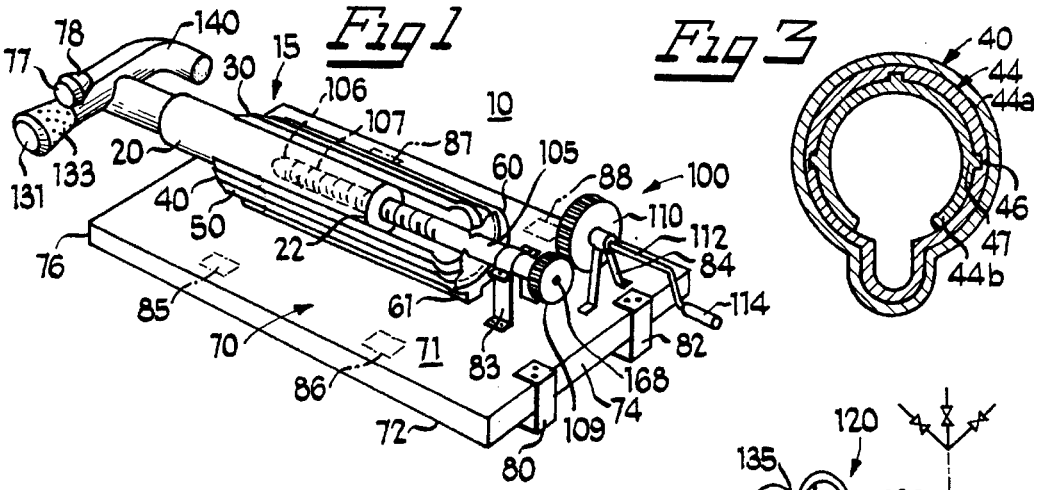
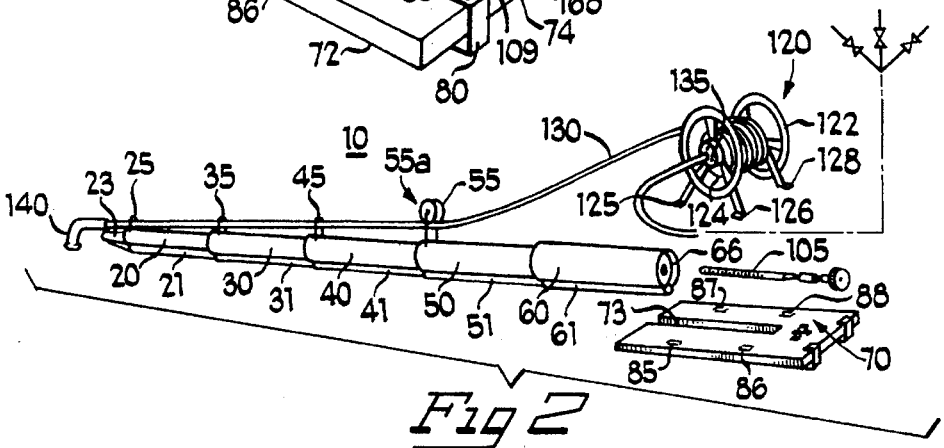
Fig 2
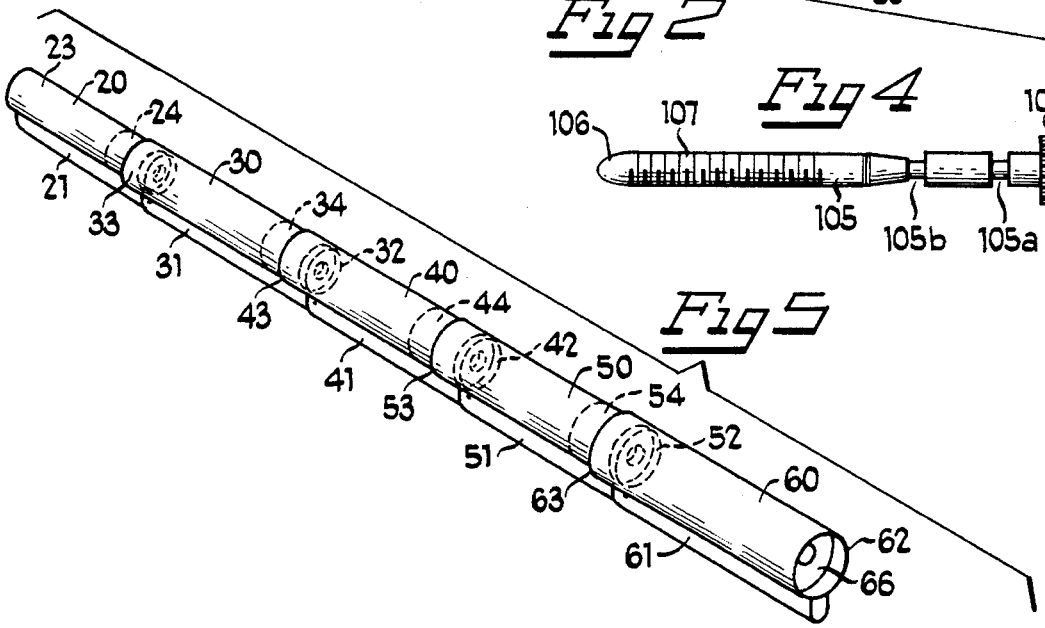
Fig 4
Fig 5
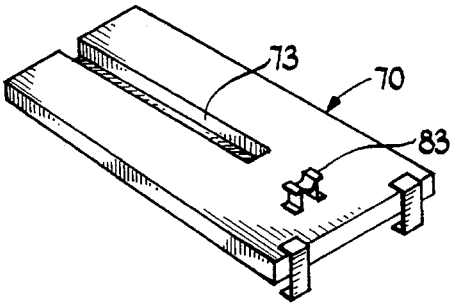

120
124a
122
130
124b
135
147
127
128
124
125
126

90
92
92
94
94
21-51
31-61

130
190
20
30
40
50
52
118
115
15
74
76
140
77
71
70
63
60

130
50
118
60
70
140
20
30
40
15
133
131

132
160
133
134
130
162
131
164
150
120
184
124
180
182
186
172
173
188
135
174
135e
135d
135a
135c
138
138a
135b
137a
137
165
147
170

Fig 15
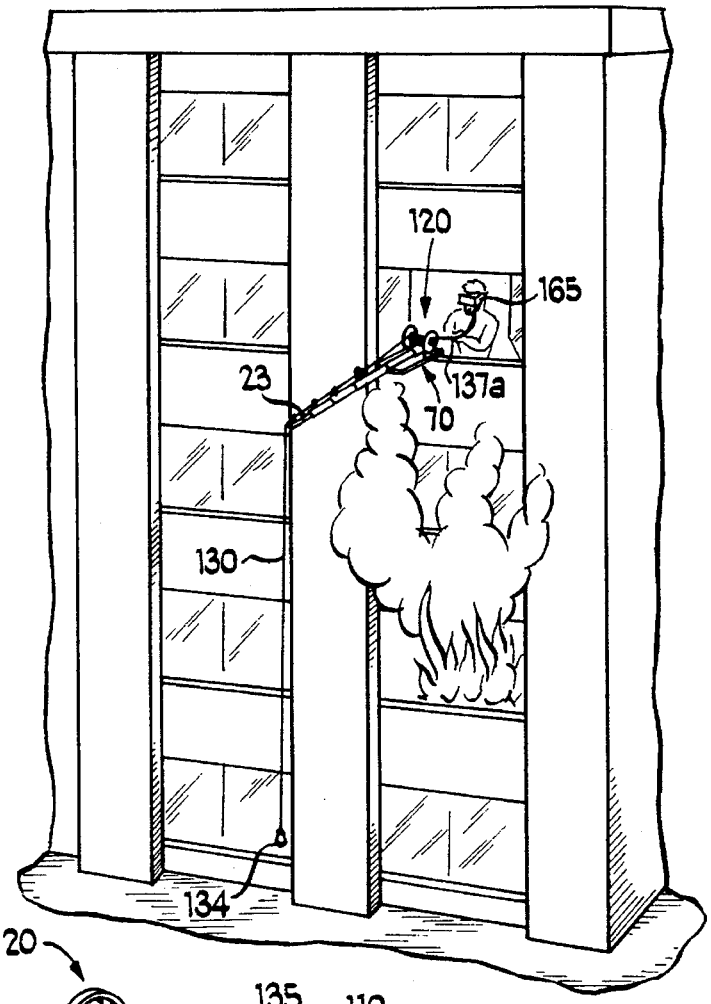
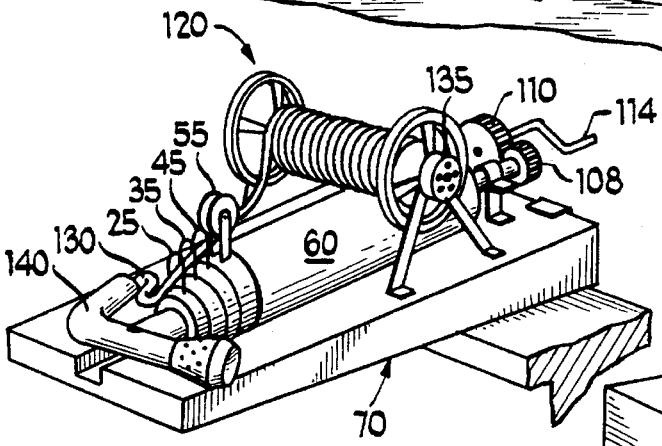
Fig 16
Fig 17
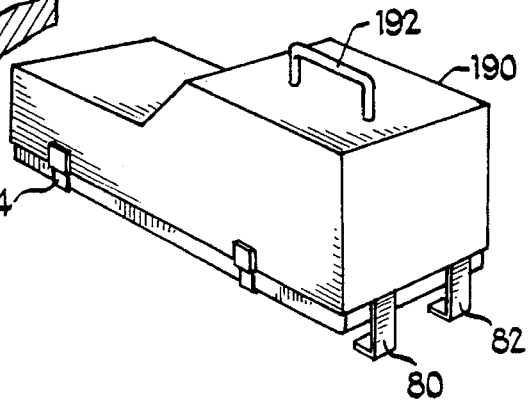

PORTABLE DEVICE FOR PROVIDING AIR TO THOSE TRAPPED WITHIN A BURNING BUILDING

This invention relates to devices for providing air to those, either persons or animals, in a building which is on fire, particularly multi-story buildings and, even more particularly, to portable devices which can be removably implemented when needed in multi-story buildings without requiring structural renovation or costly adaption construction before utilizing the device.

BACKGROUND OF THE INVENTION

Despite advances in health and safety requirements for residential buildings, for office buildings and for other multi-story facilities, one of the leading causes of health and safety hazard in the event of fire continues to be smoke inhalation. Lack of oxygen and the presence of noxious fumes caused by fire are additional hazards that threaten the health and lives of those trapped within burning buildings. A variety of inventions have been devised to attempt to ameliorate the hazards of smoke inhalation, the presence of combustible gases, noxious fumes and the like, but these inventions do not avail a low-cost, portable device that can be implemented simply and quickly to help get air to persons or animals trapped within a burning building.

For example, in U.S. Pat. No. 4,703,808 issued to O'Donnell, there is disclosed a smoke eliminator for removing smoke, heat and combustion gases from a burning structure. This device is comprised of a rigid tube having an adapter attached to one end and a fog nozzle attached to its other end. The adapter allows the device to be connected to a conventional fire hose at its base end. It is designed primarily for use by firefighters, with the intention that a firefighter insert the device into the window space of the burning building to aspirate smoke, heat and gases from the building while creating a fog curtain outside of the window to protect adjacent buildings or firefighters working outside of the burning building. This invention is not designed to get air to those trapped within the burning building.

Another invention, U.S. Pat. No. 4,380,187 issued to Wicks, is designed specifically for providing air to persons entrapped within a burning building. This invention teaches a method and system for utilizing existing water pipes to feed air to trapped occupants. An actuator connected to a number of fire sensors within the building actuates a source of pressurized air through existing hot and cold water pipes upon detecting a fire. This air jet stream blasts existing water through the pipes, then provides an atmosphere of air at slightly elevated pressure in a pre-determined room, such as a bathroom. The presumed effect of this system is to provide air to the trapped inhabitants and to exclude smoke by the air pressure differential. The problem with this system is that it presumes the protected room will be available to those trapped within the burning building. This may not always be the case. Furthermore, rooms such as bathrooms frequently are not constructed near the outside wall of multi-story, multi-unit buildings, thereby drawing trapped inhabitants away from building exteriors where fire rescue teams might be likely to access the trapped inhabitant more easily. Additionally, this system is costly and complicated to implement, requiring fire sensors and air pressure actuators to be installed before the system is operable.

Numerous other devices and systems attempt to address fire ventilation hazards by smoke evacuation systems, such as in U.S. Pat. Nos. 5,178,581 issued to Del Monte ("Smoke Evacuation System"), 4,054,084 issued to Palmer ("Fire and Smoke Free System For High Rise Building Stairways"), 4,944,216 issued to McCutcher ("Building Emergency Exhaust Fan System") and 4,928,583 issued to Taylor et al. ("Air Flow System"), as well as Japanese Patent No. 2-143042 issued to Shinjiro Miyahara ("Fire-Preventative Smoke-Discharging Device"). However, these systems and devices again are designed to systematically remove smoke, heat and noxious fumes caused by fire within a burning building as opposed to feeding air to particular inhabitants trapped within a burning building.

One object of the present invention therefore is to provide a device for providing air to those trapped within a burning building.

Another object of the present invention is to provide a device for providing air to those trapped within a burning building which is easy to use and re-use and does not require costly construction or installation work to implement.

Another object of the present invention is to provide a device for providing air to those trapped within a burning building which is portable and capable of being carried to various locations within a building which is on fire to allow a variety of users, including human inhabitants, infants, animals, firefighters, etc., to access air from outside of the building where smoke inhalation otherwise would threaten the health and even life of the user trapped inside of the building.

Still another object of the present invention is to provide a system for providing air to those trapped within a burning building which is lightweight, easy to manufacture and easy to transport from location to location within a multi-story building and adaptable to a variety of window sill constructions for use as the base support for installing the system in an emergency.

Yet another object of the present invention is to provide a system for feeding air to those trapped within a burning building which puts the user in the position to be rescued more readily by firefighters or rescue team members.

Numerous other advantages and features of the invention will become readily apparent from the detailed description of the preferred and alternative embodiments of the invention, from the claims, and from the accompanying drawings, in which like numerals are employed to designate like parts throughout.

SUMMARY OF THE INVENTION

The present invention is a portable device for providing air to those trapped within a burning building, which device is comprised of a scopic boom having a plurality of nesting tubes having an outermost tube and an innermost, stationary tube mounted to a base support which in turn is removably clamped to a window sill when positioned for use. The device is further comprised of extension means for extending the boom outward from a retracted position to access air from outside of the burning building, interlock means for locking the respective tubes in extended releasable lock fit, and air access means comprised of an air hose having a weighted end connected to said outermost tube and a reel end connected to a reel for storing said air hose when said portable device is retracted and also from which a plurality of breathing instruments depend to provide air to trapped users. In the preferred embodiment of the invention, extension is effected mechanically using a threaded shaft around which said scopic boom and nesting tubes are extended or retracted upon counter-clockwise or clockwise cranking, respectively. In an alternate embodiment of the invention, said extension is effected manually by feeding tubular extensions through said stationary tube until said outermost tube reaches the desired distance beyond its window mount. In a second alternate embodiment of the invention, air is drawn through said air hose at said reel end into a ventilated enclosure for automatically providing air to dependents such as infants or pets contained within such enclosure.

BRIEF DESCRIPTION OF THE INVENTION

A fuller understanding of the foregoing may be had by reference to the accompanying drawings, wherein:

FIG. 1 is a perspective view of the present invention showing the portable device in its retracted position;

FIG. 2 is a perspective view of the present invention showing the portable device in its extended position;

FIG. 3 is a cross-sectional view of a stationary tube and stroking nut of the present invention;

FIG. 4 is a side elevational view of the shaft of the present invention;

FIG. 5 is an exploded elevational view of the nesting tubes and base of the present invention;

FIG. 15 is a perspective view of the present invention in use in a burning building;

FIG. 16 is a perspective view of the present invention mounted on a window sill; and FIG. 17 is a perspective view of the carrying cover of the present invention.

DETAILED DESCRIPTION OF THE INVENTION

Figure 6:
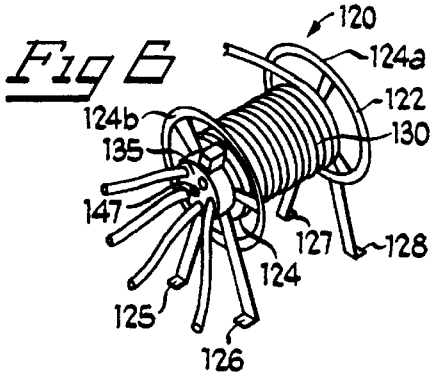
FIG. 6 is a perspective view of the hose reel which stores the breathing hose of the present invention and from which said breathing instruments depend.

While the invention is susceptible of embodiment in many different forms, there is shown in the drawings and will be described herein in detail, a preferred and alternate embodiment of the invention. It must be understood, however, that the present disclosure is to be considered an exemplification of the principles of the invention and is not intended to limit the spirit and scope of the invention and/or claims of the embodiment illustrated.

Referring now to FIG. 1, there is shown a portable device 10 for providing air to those trapped within a burning building comprised of a scopic boom 15 having a plurality of nesting tubes 20, 30, 40, 50 and 60. While the invention is depicted as having five (5) nesting tubes, it should be understood that the invention could be comprised of any number of nesting tubes. Said device 10 is further defined by a base 70 having top surface 71 and a bottom surface 72, a stationary tube groove 73 where said tube 60 mounts to said base 70, a clamp end 74, a window end 76, clamps 80 and 82 affixed to said clamp end 74 for removably securing said base 70 of said device 10 to the sill of a building opening such as a window, shaft mount brackets 83 and 84 affixed to said top surface 71 of said base 70, and hose reel mounts 85, 86, 87 and 88 located on said top surface 71 of said base 70. Base 70 is preferably thicker at clamp end 74 than at window end 76 such that top surface 71 slopes downward toward window end 76 The slope could be approximately fifteen degrees to facilitate the extension of the tubes. Alternatively, base 70 could be level and groove 73 could be sloped.

Said device 10 is further defined by extension means 100. In the preferred embodiment of the invention shown in FIG. 1, said extension means 100 is comprised of a shaft 105 having a cone-shaped tip end 106, threads 107, a crank end 108 and crank teeth 109, and a crank gear 110 on a shaft 112 mounted by shaft mount bracket 84 and rotated by a crank handle 114, which cooperatively associates with said crank teeth 109 of said shaft 105 to rotate said shaft 105 counterwise clockwise for extension of said device 10 or clockwise for retraction of said device 10. In the preferred embodiment of the invention, tubes 20 through 60 have integral U-shaped unibody bottom portions 21, 31, 41, 51 and 61, respectively, shaft ends 22, 32, 42, 52 and 62, respectively, air ends 23, 33, 43, 53 and 63, respectively and shaft nuts 24, 34, 44, and 54, respectively, which shaft nuts 24–54 are centered at said shaft ends 22–52 of said tubes 20–50 (see FIG. 5), respectively, in coaxial alignment with said shaft 105 to cooperatively associate with said shaft 105 by engaging said shaft threads 107 when said shaft 105 is cranked counterclockwise for tube extension or clockwise for tube retraction. Said shaft 105 is mounted to said top surface 71 of said base 70 by said mount bracket 83, with said stationary tube 60 further secured in place on said base 70 by affixing the unibody bottom portion 61 within said groove 73 by any suitable means. Stationary tube 60 further includes a tube cover 66 at shaft end 62.

FIG. 2 further depicts the portable device 10 as having air access means 120 comprised of a reel 122, shown independently in FIG. 6, having a hollow reel barrel 124 and reel mounts 125, 126, 127 and 128 for securing said reel 122 to said top surface 71 of said base 70 at mount sites 85, 86, 87 and 88, with said reel barrel 124 straddled over said tube 60. Reel barrel 124 can be any suitable size, but is preferably less than the width of the base 70 to accommodate a removable cover. The diameter of the barrel can vary depending on the length of the hose being used. Said air access means 120 is further comprised of air hose 130 having a reel end 132 connected to said reel barrel 124 to deliver air into its hollow, and a weighted end 134. Said air hose 130 is wrapped around said barrel 124 when said device 10 is in a retracted position, and extended along the longitudinal axis of said scopic boom 15 when said device 10 is extended and depends from the end thereof. Said air access means 120 is further defined by angled pipe 140 connected to said air end 23 of said outermost tube 20, through which angled pipe 140 said weighted end 134 of said air hose 130 is threaded to help prevent creasing of said air hose 120 upon extension or retraction activity. Said air access means 120 is further defined by a plurality of breathing instruments (see FIG. 10) connected to a breathing instrument connector 135 mounted to said hose reel barrel 124 to access air delivered through said hose 130 and through the hollow of said barrel 124 as will be described in more detail later.

In the preferred embodiment of the invention, said hose 130 is secured to said device 10 by hose loops 25, 35, 45, and 55 affixed to the upper exterior tube surfaces of tubes 20, 30, 40, and 50, respectively, to secure said hose 130 in longitudinal tube alignment upon extension of said device 10. Tube 60 may also contain a hose loop to guide the hose during extension and retraction. The hose loop closest to barrel 124, loop 55 in FIG. 2, preferably includes roller means 55*a* along its top arch to facilitate smooth extension and retraction of hose 130.

FIG. 3 shows a cross-sectional view of a tube 40, for example, and shaft nut or stroking nut 44 of the present invention. It should be understood that FIG. 3 could be illustrative of any tube of the invention having a stroking nut. As can be seen, stroking nut 44 rests inside tube 40 and is comprised of a sleeve 44*a* substantially the same configuration as tube 40. Sleeve 44*a* has a plurality of grooves 46 formed in an interior surface. A threaded stroking cylinder 44*b* is movably positioned inside sleeve 44*a*. Cylinder 44*b* contains a plurality of ribs 47 which rest in grooves 46 to prevent the cylinder from rotating. The stroking nuts 24–54 will be described further with reference to FIG. 12.

As can be seen in FIG. 4, a shaft 105 has a cone-shaped tip end 106, threads 107, and a crank end 108 having teeth 109. Shaft 105 further includes recessed portions 105*a* and 105*b*. Recessed portion 105*a* receives and is rotationally supported by mounting bracket 83. Recessed portion 105*b* receives and is rotationally supported by tube cover 66. Shaft 105 preferably tapers inward towards recessed portion 105*b* on the thread side to facilitate the nesting of the tubes in their retracted position.

FIG. 5 is an exploded elevational view of four of the extended tubes 30–60 of the present invention showing stroking nuts 34–54 therein.

FIG. 6 illustrates the air access means 120 of the present invention comprising hose reel 122 and hose 130. Hose reel 122 includes a hollow reel barrel 124 and two hand wheels 124*a* and 124*b* used to rotate hose reel 122. A reel end 132 of hose 130 connects and provides air passage to the hollow reel barrel 124 near hand wheel 124*a* (see FIG. 10). At hand wheel 124*b*, breathing instrument connector 135 is rotationally connected by bearings to the hollow reel barrel 124 in fluid communication therewith. The bearings allow the reel 122 to rotate without rotating the breathing instrument connector 135. Breathing instruments are selectively inserted into the breathing instrument connector as is described more fully later.

Figure 7:
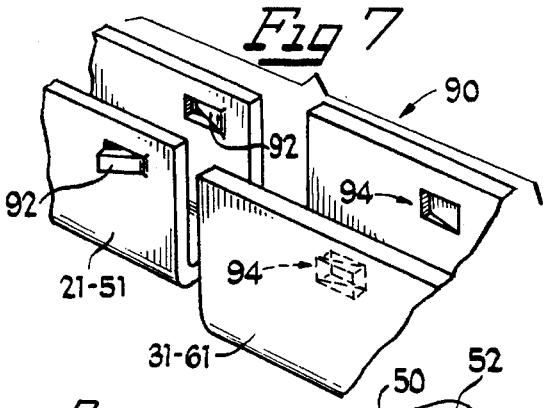
FIG. 7 is a perspective view of the interlocking means of the present invention which operate to releasably lock said nesting tubes in extended position.

As shown in FIG. 7, said device 10 is further defined by interlock means 90 comprised of a set of pins 92 integrally formed in an exterior surface of each of said tubes 20–50 near the shaft ends 22–52, respectively, preferably on the sides of said unibody bottom portions 21–51, respectively. Each set of pins 92 cooperatively associates with a set of pin cavities 94 integrally formed in an interior surface of each of said tubes 30–60 near said tube air ends 33–63, respectively, preferably on the sides of said unibody bottom portions 31–61 to lock an extended tube in extended position upon counter-clockwise cranking of said shaft 105 and said crank 110. Pins 92 are biased outward by springs such that when pins 92 reach pin cavities 94, the pins spring into the cavity and lock the members. Pin cavities 94 are slanted at a first end to allow pins 92 to easily enter the cavities, and exit the cavities upon retraction. As the smaller tube is being retracted into the larger tube, pins 92 in the smaller tube easily ride up the slanted surface of cavities 94 and fold back into the smaller tube, against the bias of the pin spring.

Figure 10:
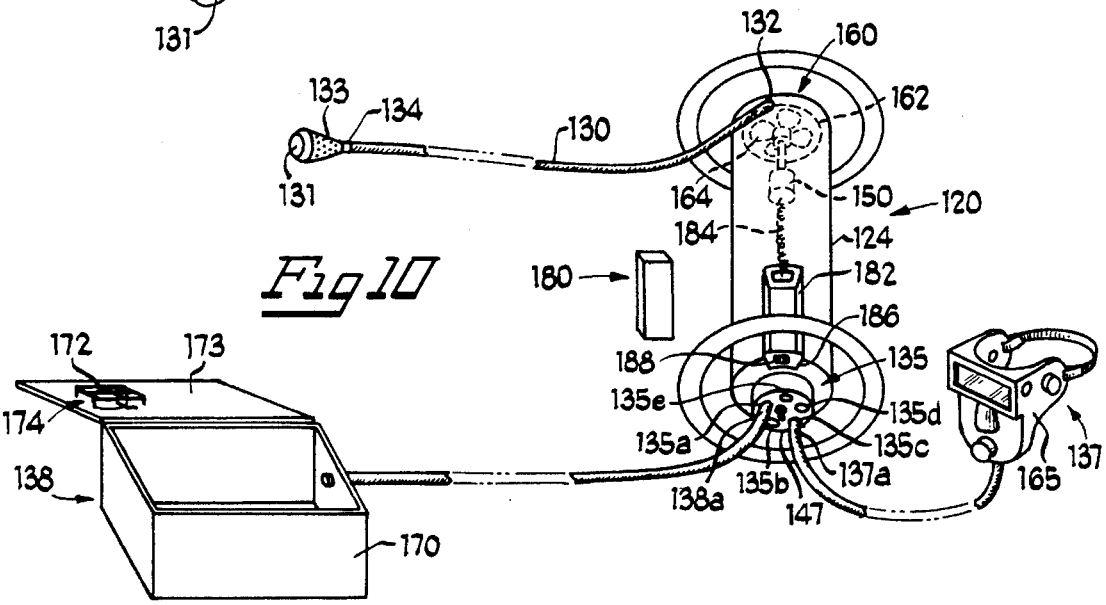
FIG. 10 is a partially broken away perspective view of the hollow reel barrel and air access means of the present invention illustrating a breathing instrument adapted for dependent users such as infants or pets protected from smoke inhalation by directing air automatically into a fireproof lifebox temporarily housing the dependent.

FIG. 10 most clearly illustrates the air access means 120 of the present invention. Hose 130 has reel end 132 connected to and leading inside of hollow reel barrel 124. Hose 130 further has a weighted end 134 which includes a weighted bottom compartment 131 and an air receiving upper compartment 133. Inside hollow reel barrel 124 is a fan ventilator 160 which automatically draws air through hose 130 and to users of the breathing instruments. Fan ventilator 160 is comprised of a housing 162 and a fan 164. Fan 164 is run by a motor 150 operatively connected to the fan. The motor 150 is preferably powered by a rechargeable battery 180 which rests in battery housing 182 in barrel 124. The battery 180 is connected to the motor 150 through electrical communicator 184. Battery housing 182 includes a removable cover 186 to allow access to battery 180. Removable cover 186 preferably includes a recharger jack 188 to allow the battery 180 to be recharged without having to remove battery 180 from housing 182. Battery 180 will preferably last six (6) to eight (8) hours. Should the battery run out, air can still be drawn to users even without the fan running, but not as easily.

Breathing instrument connector 135 is rotatably attached to reel barrel 124. Connector 135 is illustrated as a circular box-like chamber or housing having a plurality of access openings 135*a–e*. While illustrated as five, it should be understood that connector 135 could have any number of openings. Diaphragms 136*a–e* (not shown) cover access openings 135*a–e* until opened upon insertion of a breathing instrument.

FIG. 10 further illustrates breathing instruments 137 and 138 connected to connector 135. Breathing instrument 137 is an air mask 165 which a user wears to receive air drawn from hose 130 and through barrel 124. Breathing instrument 138 is an air tight, fireproof lifebox 170 in which a pet or dependent user may be placed to receive air drawn through hose 130. Lifebox 170 is preferably for infants, pets or other inhabitants incapable of voluntarily connecting themselves to a breathing instrument 137, for example. Lifebox 170 preferably has a spring loaded decompression valve 172 on top surface 173 which automatically opens when pressure in the box becomes to great, thereby relieving the pressure. Valve 172 is preferably guarded by a screen 174 so that an inhabitant in the box cannot physically manipulate valve 172. Infants, pets or other dependents who would require breathing assistance not adaptable to a breathing instrument 137 or breathing mask 165 connected to the breathing connector 135 could be placed temporarily and safely within said lifebox with life-sustaining air provided therein until rescue team members were available to remove the inhabitant from the burning building. Lifebox 170 could be any size or shape and have any type of air-tight access means such as a hinged lid.

Figure 11:
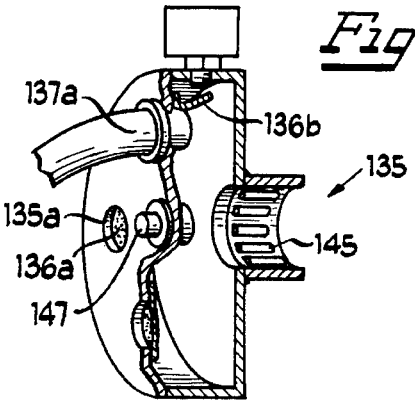
FIG. 11 is a partially broken away perspective view of the breathing instrument connector of the present invention.

FIG. 11 is a partially broken away perspective view of breathing instrument connector 135. Connector 135 is a box-like housing rotationally connected to reel 122 by bearings 145, and including a plurality of air access openings 135*a–e* having diaphragms 136*a–e*. Connector 135 is capable of receiving one or more breathing instruments, including masks 165 or lifeboxes 170 or any combination thereof. Breathing instrument air hoses are plugged into air access openings 135*a–e* whereupon diaphragms open to provide air to the user of the breathing instruments. Diaphragms 136*a–e* can be any suitable air valves or air chokes which open upon connection of the air hoses by any suitable means. Breathing instrument connector 135 preferably includes an on/off button 147 operatively connected to motor 150 to selectively start and stop operation of the ventilation system of the present invention.

Figure 12:
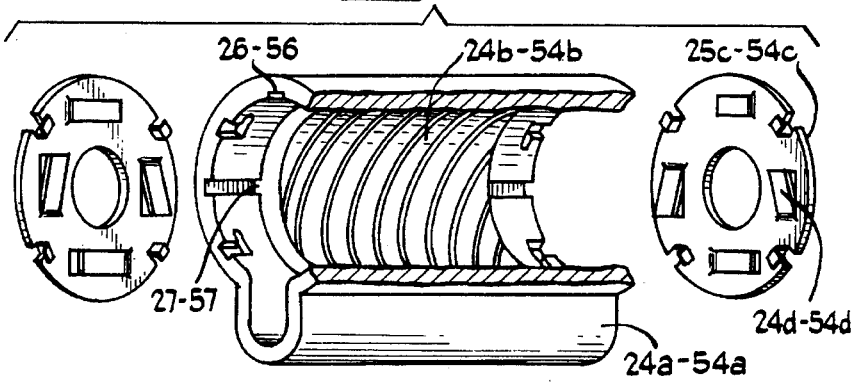
FIG. 12 is a broken away perspective view of the stroking nut of the present invention.

Also in the preferred embodiment of the invention, said shaft nuts 24–54 or stroking nuts are depicted in FIG. 12 being capable of engaging said shaft threads 107 in both forward and reverse directions, with said shaft nuts 24–54 being comprised of a sleeve, 24*a*–54*a*, a threaded stroking cylinder, 24*b*–54*b*, side covers 24*c*–54*c* and leaf springs 24*d*–54*d*, respectively. During extension of boom 15, shaft 105 is rotated, whereupon shaft nut or stroking nut 24 engages threads 107 of shaft 105. Tube 20 is propelled forward until the set of pins 92 on tube 20 lock with the set of pin cavities 94 on tube 30. Once locked, tube 30 begins extending, being pulled by tube 20, whereupon stroking nut 34 engages threads 107 of shaft 105 as nut 24 leaves threads 107 at tip end 106. This successive locking of tubes and engaging of nuts on the threads 107 continues until boom 15 is fully extended. To assure each nut engages threads 107 of shaft 105, threaded stroking cylinder 24*b*–54*b* slides back and forth in sleeve 24*a*–54*a* until the threads engage. Leaf springs 24*d*–54*d* in side covers 24*c*–54*c* bounce the cylinder back and forth to help cylinder 24*b*–54*b* move into proper position to engage the treads. Ribs 27–57 in grooves 26–56 prevent cylinder 24*b*–54*b* from rotating in sleeve 24*a*–54*a*. Cylinders 24*b*–54*b* will move back and forth or stroke a distance equal to the distance between threads 107 on shaft 105 to make sure the threads will engage. Side covers 24*c*–54*c* attach to the sides of sheath by any suitable means, illustrated as a bayonet type or tongue-in-groove connector.

Figure 13:
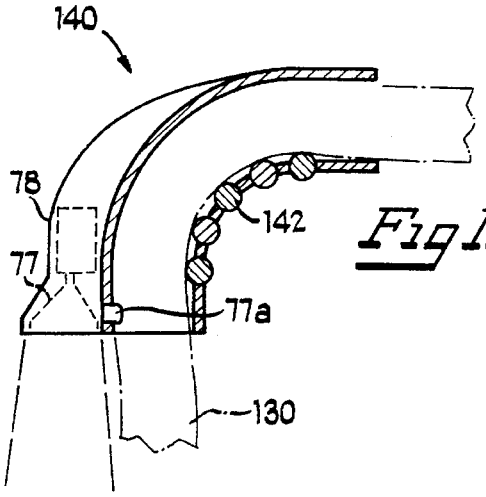
FIG. 13 is a side elevational view of the angled pipe of the present invention.

FIG. 13 shows a cross-sectional view of angled pipe 140. As can be seen, angled pipe 140 includes rollers 142 suitably attached at the inward bend to facilitate extension and retraction of hose 130. Also seen in FIG. 13 is an "in-use" warning light 77 attached to the outside of angled pipe 140. Light 77 is set inside light housing 78 which also includes a battery therein. Light 77 preferably faces downward and flashes to alert rescuers to the location of trapped individuals. Preferably, angled pipe 140 includes light switch 77*a* which is activated and deactivated by weighted end 134 of hose 130 (see FIGS. 8–10). Switch 77*a* preferably is biased downward by gravity or a spring, for example, into an on-position. When hose 130 is retracted, weighted end 134 preferably extends slightly into angled pipe 140, thereby lifting switch 77*a* into its off-position. When hose 130 is extended or dropped, weighted end 134 leaves angled pipe 140, thereby causing switch 77*a* to be biased to its on-position. Light housing is illustrated as being integrally formed at the outermost end of the angled pipe, however, it should be understood that the light and housing could be positioned anywhere on the angled pipe, such as on its side, or positioned elsewhere on the present invention, so long as it can be seen and draw attention. The angled pipe preferable is designed to be able to swivel about its connection with tube 20 to facilitate extension and lowering of the hose.

FIG. 15 illustrates the present invention in use in a burning or smoke filled building. Base 70 is suitably mounted to a window sill of the building. The boom of the invention is extended out from the building, thereby extending over or through and away from the smoke. Air hose 130 of air access means 120 is extended and dropped downward from the air end 23 of the outermost tube. Weighted end 134 facilitates extension of the hose so that air can be drawn from a ground area free from smoke. A user wearing breathing instrument mask 165 can be seen having breathing instrument hose end 137*a* connected to the air access means 120.

FIG. 16 illustrates the present invention suitably mounted to a window sill in its unextended, fully retracted position. Base 70 sits partially on and extends outward from the window sill. Air access means 120 is mounted on the base. Hose 130 is threaded through hose loops 25–55, and angled pipe 140. The tubes of the boom are substantially nested inside stationary tube 60. Breathing instrument connector 135 is attached to the hose barrel. Crank gears 108 and 110 are mounted to base 70 and extend the boom via crank handle 114.

FIG. 17 illustrates the removable cover 190 of the present invention. Cover 190 includes carrying handle 192 so that the compact portable device can be easily lifted and moved. Cover 190 preferably fits just around or on top of base 70 and is fastened thereto by suitable fasteners such as clips 194. Clamps 80 and 82 remain outside of and free from cover 190.

The preferred embodiment of the portable device 10 therefore operates as follows. In the event of imminent danger and health hazard caused by fire and smoke from a burning building, the portable device 10 provides air to those trapped within the burning building by opening a nearby window, affixing the base 70 to the window sill using clamps 80 and 82, with said clamp end 74 toward the building interior and said window end 76 extending from the building exterior, then cranking said crank handle 114 in a counter-clockwise direction. Crank teeth 109 cooperatively associate with crank 110 to rotate said shaft in a counter-clockwise direction, thereby engaging the threads 107 of said shaft 105 with said threaded shaft nut 24 of tube 20 and consequently urging said tube 20 outward away from said clamp end 74 of said base 70. As crank 110 continues to be turned in a counterclockwise direction, shaft nut 24 leaves said shaft threads 107 after engaging said interlock means 90 between tube 20 and tube 30 by locking said pins 92 of said tube 20 with said pin cavities 94 of tube 30. Said shaft nut 34 of tube 30 then proceeds to engage shaft threads 107 to urge forward or outward said tube 30 along said shaft 105 upon counter-clockwise rotation of said shaft 105, thereby also continuing to push outward said tube 20, until said shaft nut 34 leaves said shaft threads 107 after engaging said interlock means 90 between tube 30 and tube 40 by locking said pins 92 of said tube 30 with said pin cavities 94 of tube 40. This extension process continues with counter-clockwise rotation of said shaft 105 until said shaft threads 107 have engaged shaft nuts 24, 34, 44 and 54, thereby bringing said boom 15 to a fully extended position, which can be accomplished in a matter of seconds. Upon extension, said weighted end 134 of said air hose 130 also is extended, thereby unravelling hose 130 from its storage position on reel barrel 124. Said weighted end 134 drops to bring said hose 130 to a clean air position or lower elevation relative to building smoke. Upon extension of said device 10, any number of said breathing instruments 137 and/or 138 are available for accessing air by inserting their hose ends 137*a* and/or 138*a* into access openings 135*a–e* to open diaphragms 136*a–e*, respectively. The device 10 is retracted by reversing the crank process through clockwise cranking of said crank 110 and shaft 105, thereby drawing said tubes 20–50 in reverse order back into storage or nested position on said base 70. Hose 130 can be reeled up onto barrel 124 either before or after retraction of tubes 20–50.

In the preferred embodiment of the invention, said weighted end 134 of hose 130 is pyramid shaped and divided into a bottom compartment 131 which is weighted for gravity and stabilization, and an upper compartment 133 having air holes for drawing lifesaving air into said air hose 130 for delivery to occupants as needed. Weighted end could be sand filled, solid metal, or any suitable weight. The weight of end 134 can be adjusted accordingly to the size of the hose 130.

The unibody design of the nesting tubes affords backbone for increased durability and strength, and means for avoiding spinning of the tubes once extended, as well as additional interlock features.

In the preferred embodiment of the invention, said scopic boom 15 provides 10–12 feet of building clearance upon full extension, and 150 feet or more of fire resistant hose 130 for delivering air to users with said air hose 130 being approximately one-half inch in diameter. It should be understood that hose 130 diameter could be less with the ventilation system in place. Preferably, said hose 130 carries a coil spring integrally formed therewithin to prevent hose collapse or breakage. The preferred size of the entire unit ranges from approximately two feet long at most to sixteen inches high at most to fourteen inches wide at most, similar to a medium sized suitcase. The nesting tubes may vary in thickness, with each nested or small tube being diminished in thickness. For example, tube 60 could be three inches, tube 50 at 2⅞ inches, tube 40 at 2¾ inches, tube 30 at 2⅝ inches and tube 20 at 2 ½ inches. The tubes are preferably made from strong, lightweight aluminum to enhance portability and ease, extension and retraction. Additional tubes could be used to increase the extension distance of the hose away from the building. Base 70 could additionally have leveling screws to facilitate level mounting to a window sill.

Figure 8:
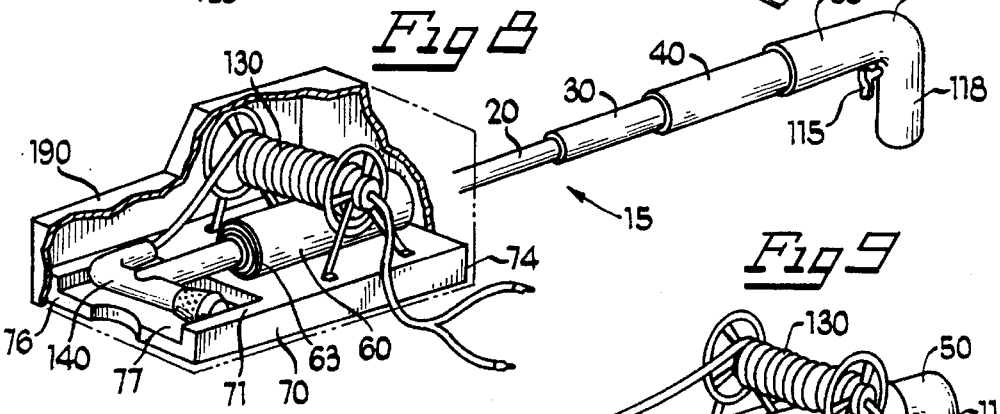
FIG. 8 is a perspective view of an alternate embodiment of the present invention in a retracted position but poised for manual extension.
Figure 9:
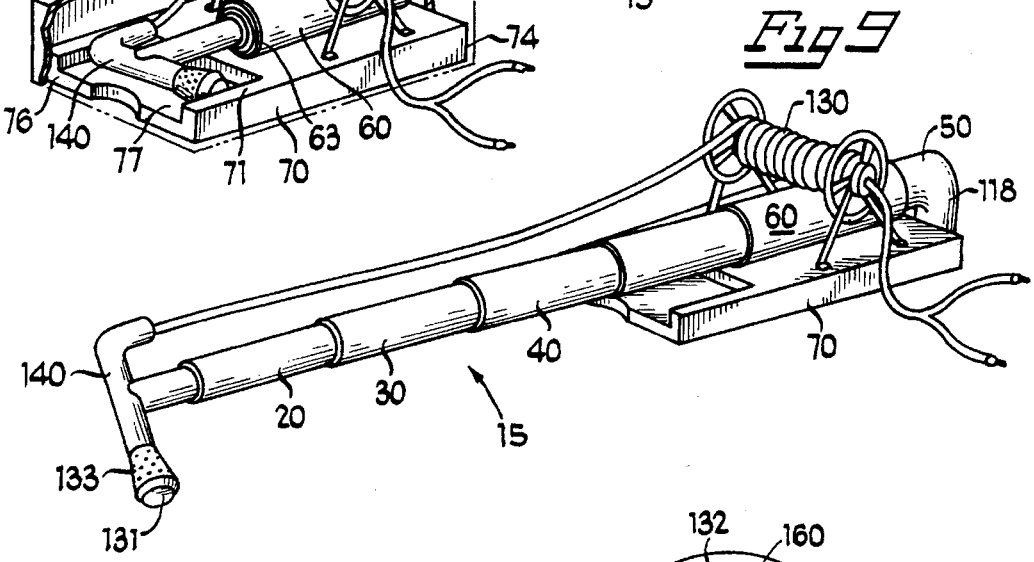
FIG. 9 is a perspective view of the alternate embodiment of the present invention depicted in FIG. 8 in an extended position.
Figure 14:
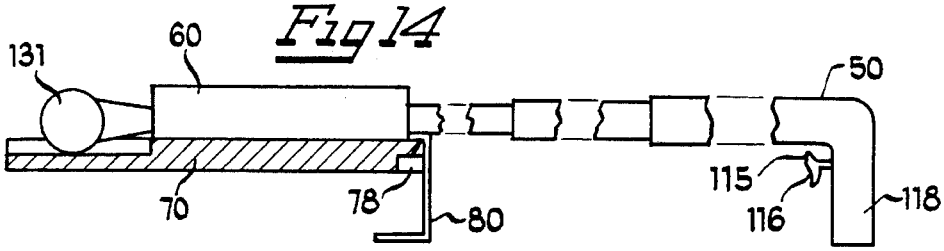
FIG. 14 is a side elevational view of the alternate embodiment of FIG. 8.

FIGS. 8, 9 and 14 depict an alternate embodiment of the invention whereby said extension means 100 does not utilize said shaft 105 or stroking nuts 24–54, but rather, is manually implemented. In this embodiment of the invention, said boom 15 is comprised of said stationary tube 60 and separate nesting tubes 20–50. Said angled pipe 140 rests in recessed portion 77 on said top surface 71 of said base 70 near said window end 76 inside said air end 63 of said tube 60. Nesting tubes 20–50, stored separate from base 70, are manually extended and locked in place using interlock means 90, with said tube 50 having a grip handle 118 located at its shaft end 52. Said extended tubes 20–50 then are inserted into stationary tube 60 from said clamp end 74 until engaging angled pipe 140 via any suitable coupling. Upon continuing to utilize said grip handle 118 to push said tubes 20–50 through said stationary tube 60, said angled pipe 140 continues to be extended outward away from the burning building, thereby unravelling air hose 130. Upon full extension of said tubes 20–50, clip spring 115, connected to said grip handle 118 of tube 50 clips said tube 50 to said clamp end 74 of said base 70 by engaging a notch 78 under base 70. Upon engagement of said angled pipe 140 with said tube 20 and manual extension by pushing grip handle 118 outward, air hose 130 likewise is gradually extended longitudinally with said scopic boom 15. Retraction of said portable device 10 in this alternate embodiment also is manually achieved by gripping said grip handle 118 and withdrawing said tubes 20–50 in reverse order back toward said stationary tube and into retracted position. Clip spring 115 has a trigger 116 attached thereto, whereupon a user holding handle 118 pulls trigger 116 to release clip spring 115 from notch 78. FIG. 8 illustrates a removable cover 190 which is placed over the invention when not in use.

It is foreseen that the boom 15 of the present invention could be extended by any suitable means not limited to the means described above. For example, the boom could be extended electrically, hydraulically, pneumatically, or by springs in an accordion-like fashion.

The benefits of such a system are enormous. Besides the immediate life saving benefits of users, the system provides greater safety to firefighters who may not need to go rushing into a burning, smoke-filled building. Further, insurance companies and building owners would benefit enormously in the number of insurance claims filed, the severity of the claims, and the cost of insurance policies. Further, families, individuals, or others might be more inclined to rent or buy an apartment or space in a building having such a safety system.

It is to be understood that the embodiments herein described are merely illustrative of the principles of the present invention. Various modifications may be made by those skilled in the art without department from the spirit or scope of the claims which follow.

What is claimed is:

1. A device for providing air to a user trapped within a smoke-filled building, comprising:

a base member for releasably connecting said device to said building;

air access means mounted to said base member for providing air to said user said air access means comprises a reel mounted to said base member, a hose on said reel, and at least one breathing instrument selectively, removably connected to said reel; and extension means mounted to said base member for positioning said hose away from said building.

2. The device of claim 1, wherein said reel comprises a hollow reel barrel and means for rotating said hollow reel barrel.

3. The device of claim 2, wherein one end of said hose is connected and provides air to said hollow reel barrel.

4. The device of claim 3, wherein a breathing instrument connector is rotatably attached to said hollow reel barrel and selectively receives said at least one breathing instrument.

5. The device of claim 4, wherein said breathing instrument connector comprises breathing instrument access openings, said access openings having diaphragm means to selectively seal said openings, said access openings operatively receive a connecting end of said breathing instruments, said diaphragm means opening upon insertion of said breathing instruments into said access openings to provide air to said breathing instruments.

6. The device of claim 4, wherein said breathing instrument connector includes a decompression valve.

7. The device of claim 1, wherein said at least one breathing instrument is an air mask.

8. The device of claim 1, wherein said at least one breathing instrument is an air-tight lifebox.

9. The device of claim 1, wherein said extension means comprises an extendable boom.

10. The device of claim 9, wherein said boom is extended manually.

11. The device of claim 9, wherein said boom is extended by crank means.

12. The device of claim 11, wherein said boom comprises a plurality of nesting tubes cooperatively associating with a crank shaft for extending said boom.

13. The device of claim 12, wherein said plurality of nesting tubes include interlocking means for locking adjacent tubes together, and threaded stroking nuts for cooperatively associating with threads on said crank shaft to selectively extend and retract said plurality of tubes upon rotation of said crank shaft.

14. The device of claim 10, wherein said boom comprises a stationary tube mounted to said base member and a plurality of nesting tubes, said nesting tubes include interlocking means, said nesting tubes being extended manually and locked by said interlocking means.

15. The device of claim 14, wherein an end tube of said nesting tubes includes a grip handle, and once said nesting tubes are extended, said nesting tubes are pushed through said stationary tube using said grip handle to extend said boom away from said building.

16. The device of claim 15, wherein said grip handle includes a clip spring having a trigger, said clip spring removably engages a notch under said base member when said boom is fully extended.

17. The device of claim 9, wherein said extendable boom includes hose loops and an angled pipe at a far end thereof, said angled pipe receiving said hose and directing said hose downward.

18. The device of claim 17, wherein said hose has a free end, said free end of said hose having a weighted lower compartment, and an upper compartment capable of receiving air.

19. The device of claim 4, wherein said hollow reel barrel has a ventilation system therein for automatically drawing air to said breathing instrument connector and said at least one breathing instrument.

20. The device of claim 19, wherein said ventilation system comprises a fan driven by a motor powered by a battery.

21. The device of claim 1, wherein said device includes carrying means for ease of maneuverability by a user.

22. A method of providing air to those trapped within a smoke-filled building comprising providing a device including a base, an extendable boom, and air access means having a breathing end and an air receiving end, mounting said base to said building near a window;

extending said boom away from said building;

lowering said air receiving end of said; and drawing air from said air receiving end through said breathing end of said hose.

23. A breathing apparatus having a ground end for use in a smoke filled building comprising:

an air supply conduit having an air receiving end and a user end;

a means for selectively storing and positioning said air conduit;

an extension means cooperatively associated with said air supply conduit for positioning said air receiving end of said air supply conduit a distance from said building; and a breathing instrument operatively connected to said user end;

and means for lowering said air receiving end of said air conduit from said extension means to said ground end of said building via said means for storing and positioning.

* * * * *